US006743978B2

(12) United States Patent
Wu

(10) Patent No.: US 6,743,978 B2
(45) Date of Patent: Jun. 1, 2004

(54) WIRE CONNECTION BOX WITH RAPIDLY-ASSEMBLED LAMP ROD

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 114 days.

(21) Appl. No.: 10/244,838

(22) Filed: Sep. 17, 2002

(65) Prior Publication Data

US 2004/0050574 A1 Mar. 18, 2004

(51) Int. Cl.[7] ..... H01J 5/00

(52) U.S. Cl. ..... 174/50; 174/48; 174/17 R; 220/4.02; 361/600; 248/906; 439/535

(58) Field of Search ..... 174/48, 50, 17 R, 174/58, 63, 65 R, 53, 60, 135; 220/3.3, 3.6, 3.8, 4.02, 3.2; 248/906; 439/535, 537; 361/600, 641

(56) References Cited

U.S. PATENT DOCUMENTS 6,037,540 A * 3/2000 Daoud ..... 174/65 R
6,069,317 A * 5/2000 Wagganer ..... 174/65 R
6,072,121 A * 6/2000 Penczak et al. ..... 174/48
6,091,023 A * 7/2000 O'Donnell ..... 174/57
6,114,624 A * 9/2000 Ghafourian et al. ..... 174/50
6,278,058 B1 * 8/2001 Anderson ..... 174/50
6,323,424 B1 * 11/2001 He ..... 174/58
6,467,640 B1 * 10/2002 Hung ..... 220/4.02
6,509,524 B1 * 1/2003 Gretz ..... 174/50
6,518,500 B1 * 2/2003 Huang ..... 174/50

* cited by examiner

*Primary Examiner*—Dhiru R Patel

(57) ABSTRACT

A wire connection box with a rapibly-assembled lamp rod or inserting rod having: a retaining seat installed at a via hole at a lateral side of the wire connection box and an inserting rod inserted in the retaining seat. A front end of the inserting rod with respect to the retaining seat is firmly secured with a rapidly-connecting joint secured to a front end of the retaining seat. In this wire connection box, the inserting rod can be pulled out from the retaining seat for packaging, transferring and storage. Since the wire connection box and the inserting rod can be detached for reducing the volume, the retaining seat inserted by the inserting rod is assembled in the wire connection box. When assembly, it is only necessary to insert the inserting rod into the retaining seat for use. No other tool, such as studs, is needed. Thereby, the user can assemble the wire connection box by himself or herself.

5 Claims, 3 Drawing Sheets

Fig. 1-A

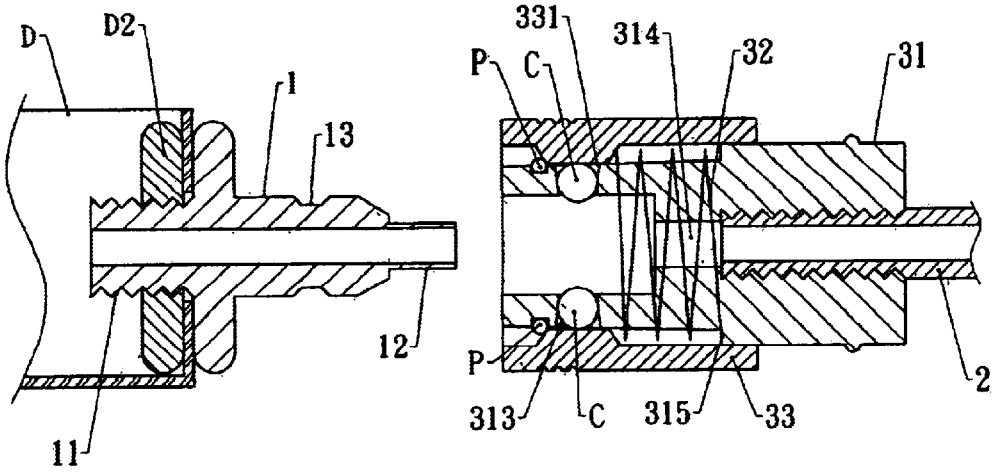
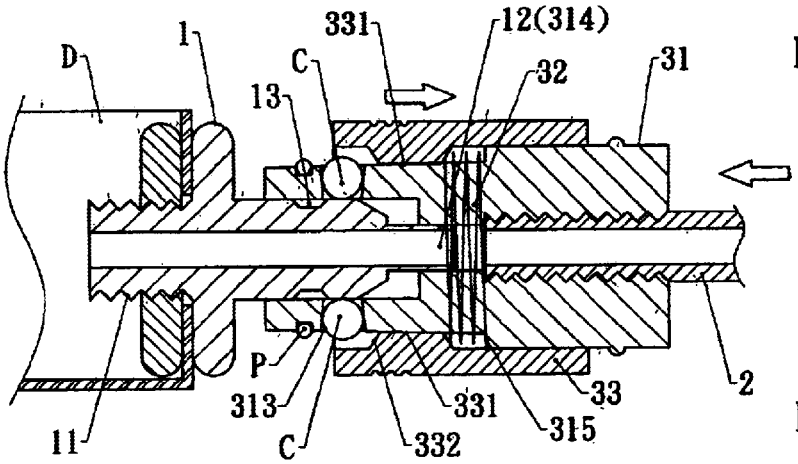
Fig. 3-A
Fig. 3-B
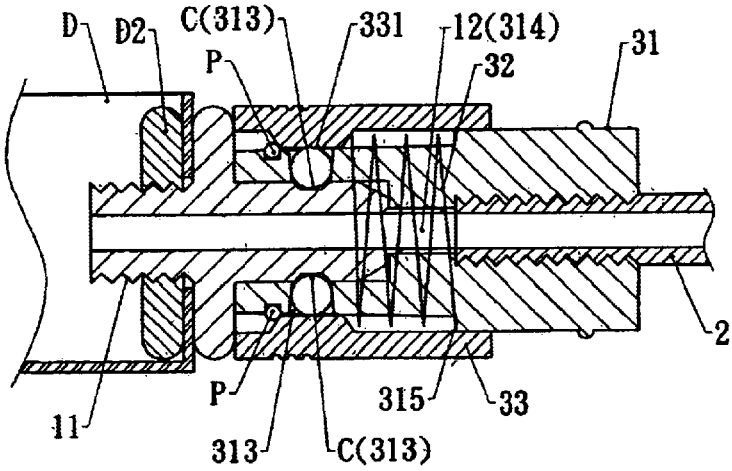
Fig. 3-C

WIRE CONNECTION BOX WITH RAPIDLY-ASSEMBLED LAMP ROD

FIELD OF THE INVENTION

The present invention relates to lamp fixing structure, and particularly to a wire connection box with a rapidly-assembled lamp rod, Where in assembly, it is only necessary to insert the inserting rod into the retaining seat for use. No other tool, such as studs, is needed. Thereby, the user can assemble the wire connection box by himself (or herself).

BACKGROUND OF THE INVENTION

Prior wire connection devices of lamps, such as wall lamps, stand type lamps, ceiling lamps, use studs and nuts to lock the components.

In assembly, not only the user is easy to be harmed, but also other locking tools (such as spanners, openers, etc.) are necessary. Moreover, in assembly, electric wires are easy to expose out and some dangers are induced. Thereby, the prior art is not suitable to be assembled by the user. In general, the manufacturer assembles the device in advance, namely, the wire box is assembled with inserting rods in the manufacturing process. However, this will induce that a large space is required for transferring and storing the wire connection device and thus cost is increased.

SUMMARY OF THE INVENTION

Accordingly, the primary object of the present invention is to provide an assembly having a wire connection box with a rapidly-assembled lamp rod or inserting rod. In assembly, it is only necessary to insert the inserting rod into the retaining seat for use. No other tool, such as studs, is needed. Thereby, the user can assemble the wire connection box by himself (or herself).

To achieve above object, the present invention provides a wire connection box with a rapidly-assembled lamp rod comprises a retaining seat installed at a via hole at a lateral side of the wire connection box and an inserting rod inserted in the retaining seat. A front end of the inserting rod with respect to the retaining seat is firmly secured with a rapidly-connecting joint secured to a front end of the retaining seat. In this wire connection box, the inserting rod can be pulled out from the retaining seat for packaging, transferring and storage. Since the wire connection box and the inserting rod can be detached for reducing the volume, the retaining seat inserted by the inserting rod is assembled in the wire connection box.

The various objects and advantages of the present invention will be more readily understood from the following detailed description when read in conjunction with the appended drawing.

BRIEF DESCRIPTION OF THE DRAWINGS

FIG. 1A is a partial enlarged view of the connecting tube of the present invention.

FIG. 3A is a cross sectional view of the present invention before insertion.

FIG. 3B is a cross sectional view of the present invention where the inserting rod is being inserted in the wire connection box.

FIG. 3C is a cross sectional view of the present invention wherein the inserting rod has been inserted into the wire connection box.

DESCRIPTION OF THE PREFERRED EMBODIMENTS

Figure 1:
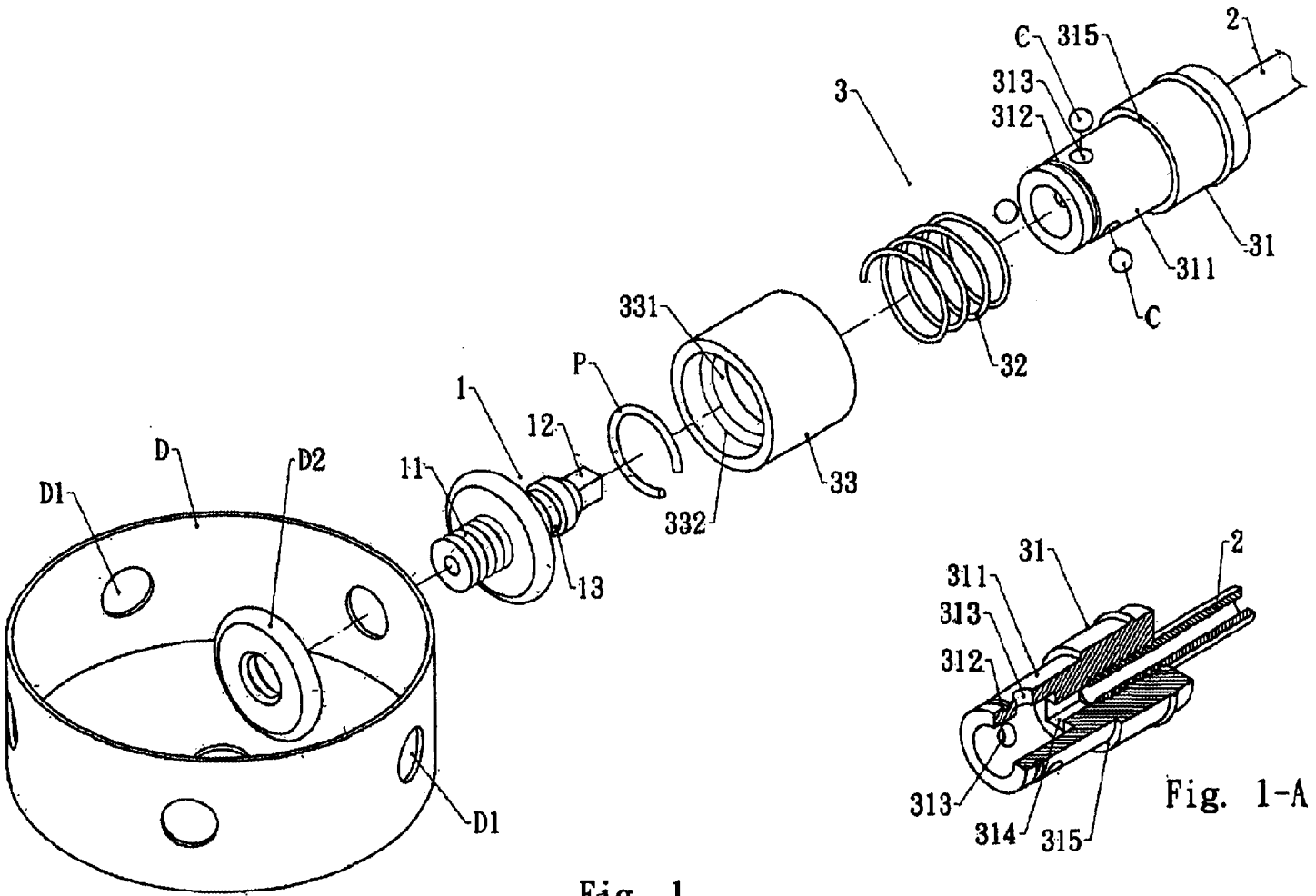
FIG. 1 is an exploded perspective view of the present invention.
Figure 2:
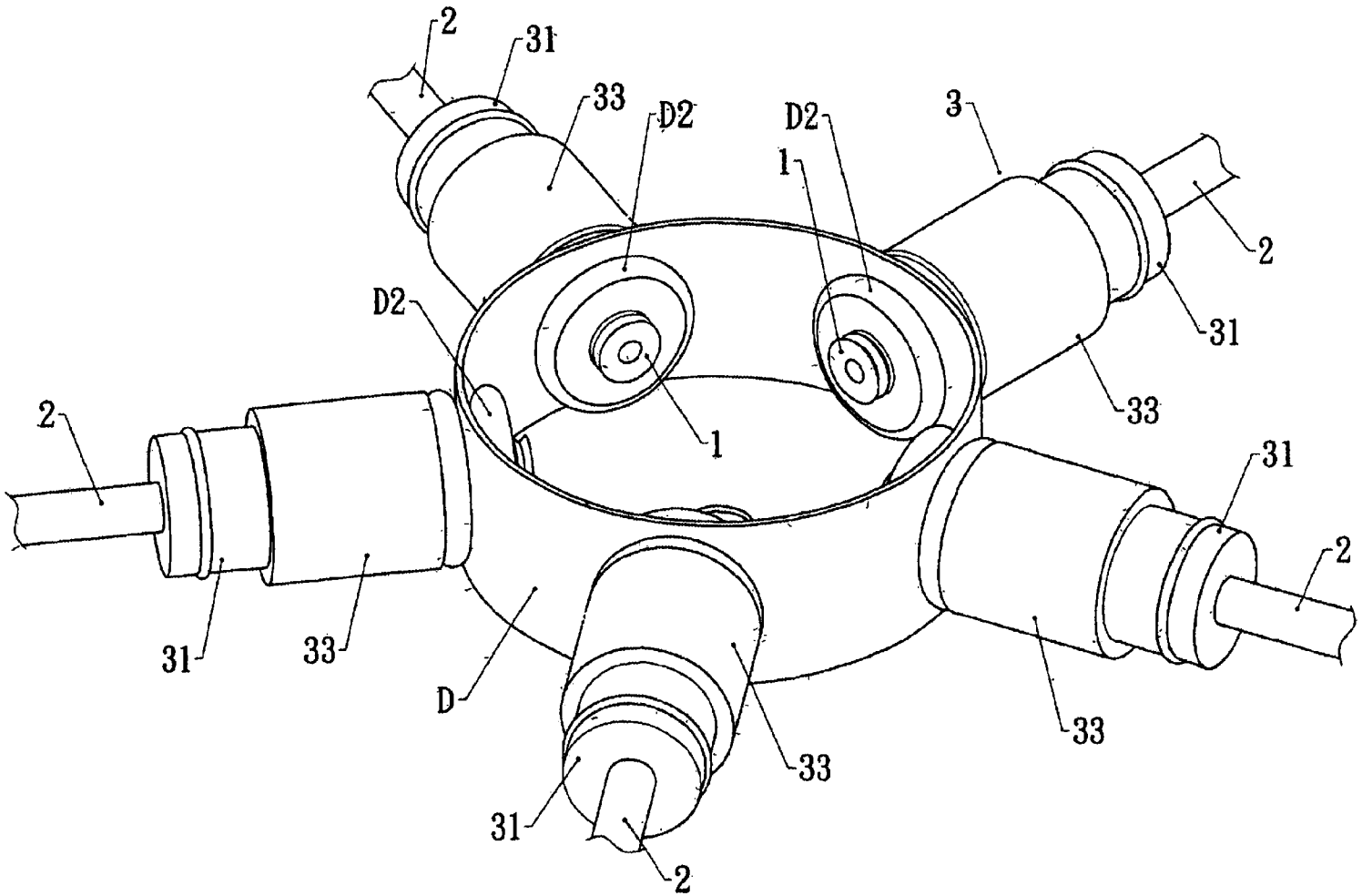
FIG. 2 is an assembled perspective view of the present invention.

Referring to FIGS. 1 and 2, the structure of the present invention is clearly shown. The present invention is formed by a retaining seat 1 installed at a via hole D1 at a lateral side of a wire connection box D, and an inserting rod 2 inserted in the retaining seat 1. A front end of the inserting rod 2 with respect to the retaining seat 1 is firmly secured with a rapidly-connecting joint 3 firmly secured to a front end of the retaining seat 1.

The retaining seat 1 has one threaded section 11 at one end thereof. The threaded section 11 is exactly inserted into a via hole D1 at the lateral side of the wire connection box D. Another end of the retaining seat 1 protruded from an outer side of the wire connection box D is exactly inserted by the rapidly-connecting joint 3. A distal end of this protruded section is a polygonal engaging portion 12. A front end of the engaging portion 12 is formed with a groove 13 for positioning steel balls.

The rapidly-connecting joint 3 is formed by a connecting tube 31, a spring 32 enclosing a smaller annular surface 311 of the connecting tube 31, and an actuating toggle 33 fixed at one outer side of the connecting tube 31 by a C ring P to resist against a spring 32.

The connecting tube 31 is a stepped middle section and the smaller annular surface 311 of the connecting tube 31 is tapered. A front end of the connecting tube 31 is installed with an embedded trench 312 for receiving the C ring P. The smaller annular surface 311 is further formed with a receiving hole 313 for receiving steel balls C. A middle section of the connecting tube 31 matched to the engaging portion 12 of the retaining seat 1 is formed with a polygonal engaged hole 314 for confining the rapidly-connecting joint 3.

The inner annular portion of the actuating toggle 33 has a resisting flange 331 at a position with respect to the steel balls C of the connecting tube 31. The resisting flange 331 and the inner annular side of the actuating toggle 33 are formed with a stepped surface 332. Thereby, one side of the spring 32 can resist against the stepped surface 315 of the connecting tube 31 and another end of the spring 32 resists against a lateral side of the resisting flange 331 of the actuating toggle 33.

The operation of the present invention will be described herein with reference to FIGS. 3A, 3B and 3C When in a normal condition, the rapidly-connecting joint 3 is not inserted into the retaining seat 1, since the spring 32 between the actuating toggle 33 and the connecting tube 31 dose not be compressed, the spring 32 resists against the actuating toggle 33, and one end of the resisting flange 331 resists against the C ring P of the connecting tube 31, while another end of the resisting flange 331 resists against a lateral side of the spring 32 so as to confine the connecting tube 31. Moreover, the actuating toggle 33 exactly resists against the outer sides of the steel balls C (referring to FIG. 3A).

When it is desired to insert the rapidly-connecting joint 3 into the retaining seat 1, the actuating toggle 33 must be pushed backwards so that the resisting flange 331 of the actuating toggle 33 compresses the spring 32 and releases from the steel balls C. Thereby, the rapidly-connecting joint 3 is inserted into the engaging portion 12 of the retaining seat 1. Then, the engaging portion 12 of the retaining seat 1 is aligned, to the engaged hole 314 of the connecting tube 31 and thus is inserted therein to (referring to FIG. 3B).

When the connecting tube 31 is inserted completely, by releasing the actuating toggle 33, since no outer force is applied to the actuating toggle 33, the actuating toggle 33 will be pushed back by the resilient force of the spring 32 to resist against the C ring P so that the steel balls C is compressed inwards. Thereby, the steel balls C can not be embedded into the groove 13 of the retaining seat 1. Thus, the rapidly-connecting joint 3 can not be retracted backwards and thus is confined in the retaining seat 1 (referring to FIG. 3C).

In this wire connection box D, the inserting rod 2 can be pulled out from the retaining seat 1 in advance for packaging, transferring and storage. Since the wire connection box D and the inserting rod 2 can be detached in advance for reducing the volume. Since the retaining seat 1 inserted by the inserting rod 2 is assembled in the wire connection box D in advance. When assembly, it is only necessary to insert the inserting rod 2 into the retaining seat 1 in the wire connection box D for use. No other tool, such as studs, is needed. Thereby, the user can assemble the wire connection box D by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

Wherein the polygonal, engaging portion of the protruded section has a shape selected from one of a group containing flat round shapes, triangular shapes, rectangular shapes, pentagonal shapes, and polygonal shapes, and the connecting tube has a shape selected from one of a group containing flat round shapes, triangular shapes, rectangular shapes, pentagonal shapes, polygonal shapes, and positioning ring at an interior of the box engaged to the threaded section of said retaining seat so that the retaining seat being locked to said outer side of the wire connection box.

What is claimed is:

1. A wire connection box and an inserting rod assembly comprising: a retaining seat, a rapidly-connecting Joint fixed to a front end of the retaining seat, a wire connection box, and the inserting rod inserted in the retaining seat, a front end of the inserting rod with respect to the retaining seat being firmly secured with said rapidly-connecting Joint; and the retaining seat firmly secured to an outer side of the wire connection box, wherein one end of the retaining seat protrudes from said outer side of the wire connection box to form a protruded section; and a distal end of the protruded section comprising a shaped engaging portion; an intermediate portion of said retaining seat having a groove for positioning steel balls; the rapidly-connecting joint comprising a connecting tube having a smaller annular surface and a stepped surface, a spring, and an actuating toggle, said connecting tube installed to said shaped engaging portion of the protruded section, said spring enclosing said smaller annular surface of the connecting tube, and said actuating toggle fixed at an outer side of the connecting tube by a C ring to resist against said spring, the smaller annular surface of the connecting tube being tapered from a front end of the connecting tube to said stepped surface; said front end of the connecting tube having an embedded trench for receiving the C ring; said smaller annular surface of said connecting tube having a receiving hole for receiving said steel balls; a middle section of the connecting tube being matched to the shaped engaging portion of the protruded section and having a polygonal engaged hole for securing the rapidly-connecting joint; the actuating toggle comprising an inner annular portion which has a resisting flange at a position with respect to the steel balls of the connecting tube, the resisting flange and the inner annular portion of the actuating toggle being formed with stepped surfaces; one side of the spring resists against the stepped surface of the connecting tube and another end of the spring resists against the resisting flange of the actuating toggle, whereby the inserting rod can be pulled out from the retaining seat in advance for packaging, transferring and storage with a smaller volume.

2. The wire connection box and the inserting rod assembly as claimed in claim 1, wherein one end of the retaining seat has one threaded section, the threaded section being inserted into a via hole at a lateral side of the wire connection box; a positioning ring at an interior of the box engaged to the threaded section of said retaining seat so that the retaining seat locked to said outer side of the wire connection box.

3. The wire connection box and the inserting rod assembly as claimed in claim 1, wherein a middle section of the connecting tube is a stepped tapered tube.

4. The wire connection box and the inserting rod assembly as claimed in claim 1, wherein the shaped engaging portion of the protruded section has a shape selected from one of a group containing flat round shapes, triangular shapes, rectangular shapes, pentagonal shapes, and polygonal shapes.

5. The wire connection box and the inserting rod assembly as claimed in claim 1, wherein the connecting tube has a shape selected from one of a group containing flat round shapes, triangular shapes, rectangular shapes, pentagonal shapes, polygonal shapes.

* * * * *